US006529161B2

(12) United States Patent
Fukushima et al.

(10) Patent No.: US 6,529,161 B2
(45) Date of Patent: Mar. 4, 2003

(54) ANTENNA CONTROL METHOD AND ANTENNA CONTROLLER

(75) Inventors: Tomoaki Fukushima, Tokyo (JP); Takeo Shimizu, Tokyo (JP); Akio Iida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/933,826

(22) Filed: Aug. 22, 2001

(65) Prior Publication Data

US 2002/0105461 A1 Aug. 8, 2002

(30) Foreign Application Priority Data

Feb. 8, 2001 (JP) ..... 2001-032838

(51) Int. Cl.[7] ..... H01Q 3/00
(52) U.S. Cl. ..... 342/359; 342/356
(58) Field of Search ..... 342/359, 356

(56) References Cited

U.S. PATENT DOCUMENTS 5,854,609 A * 12/1998 Pyo et al. ..... 342/359
5,990,928 A * 11/1999 Sklar et al. ..... 342/359
6,191,734 B1 * 2/2001 Park et al. ..... 342/359

FOREIGN PATENT DOCUMENTS

JP 5-102895 4/1993
JP 6-169212 6/1994

* cited by examiner

*Primary Examiner*—Theodore M. Blum
(74) *Attorney, Agent, or Firm*—Oblon, Spivak, McClelland, Maier & Neustadt, P.C.

(57) ABSTRACT

An antenna controller comprises an antenna beam control unit for controlling the direction of an antenna beam of an antenna, an inertial navigation system for acquiring motion information on a motion of the mobile body, an antenna beam direction calculation unit for calculating the direction of the antenna based on the motion information from the inertial navigation system to direct the antenna beam toward the geostationary satellite, a motion information acquisition unit for separately acquiring motion information on the motion of the mobile body, and a motion estimation unit for estimating a delay of the motion information acquired by the inertial navigation system based on the motion information acquired by the inertial navigation system and the motion information acquired by the motion information acquisition unit, and for estimating motion information to be sent to the antenna beam direction calculation unit in consideration of the estimated delay. The motion information acquisition unit has a 3-axis angular-velocity sensor. As an alternative, the motion information acquisition unit has a 3-axis magnetic bearing sensor.

9 Claims, 5 Drawing Sheets

FIG.3A
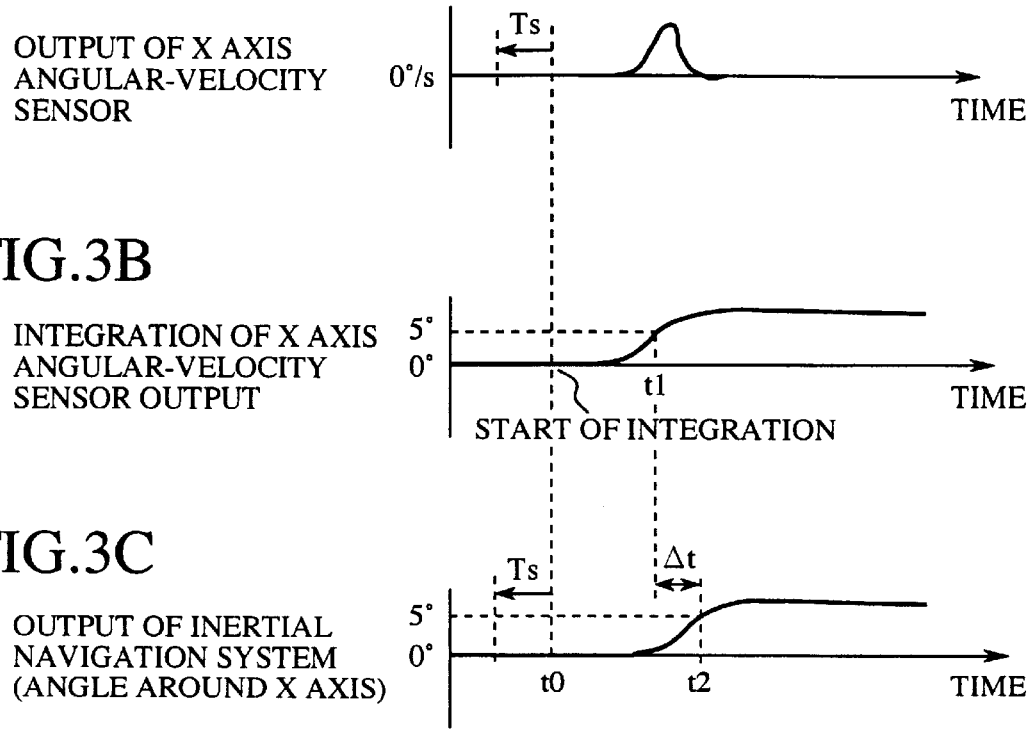
FIG.3B
FIG.3C
FIG.4
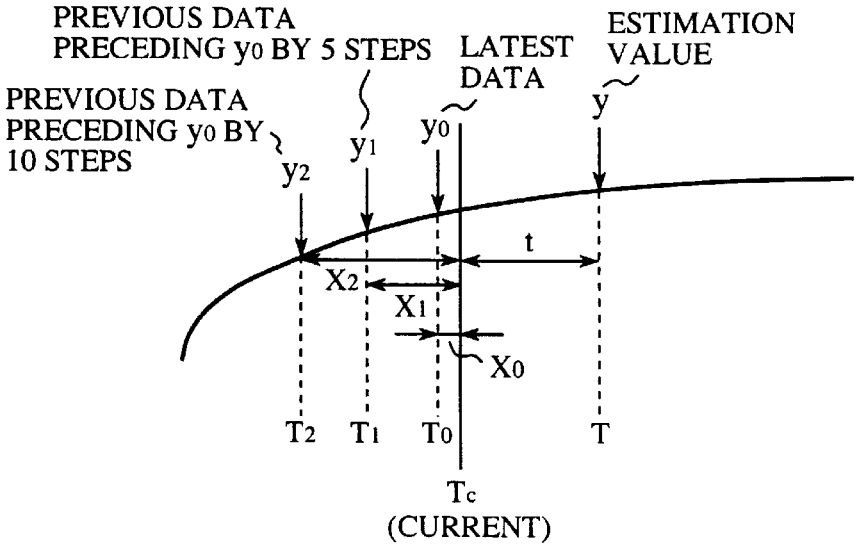

ANTENNA CONTROL METHOD AND ANTENNA CONTROLLER

BACKGROUND OF THE INVENTION

1. Field of the Invention

The present invention relates to an antenna control method of and an antenna controller for controlling the direction of an antenna beam of an antenna used for either a satellite communication earth station installed in a mobile body, such as an aircraft, or a satellite broadcast receiving facility.

2. Description of the Prior Art

FIG. 10 is a block diagram showing the structure of a prior art antenna controller used for a satellite broadcast receiver for use in aircraft, as disclosed in Japanese patent application publication (TOKKAIHEI) No. 50102895, for example. In the figure, reference numerals 11-1 to 11-n denote receive blocks each of which receives an electric wave from a geostationary satellite by way of its antenna, respectively, reference numeral 12 denotes a common-mode synthesizer for synthesizing n outputs of the antennas of the plurality of receives blocks 11-1 to 11-n after making them in phase with each other, reference numeral 13 denotes on inertial navigation system installed in a mobile body such as an aircraft, reference numeral 15 denotes an orbit data processor for converting orbit data 14 on a geostationary satellite into an electric signal, reference numeral 16 denotes a tracking control unit for generating an electric signal used for mechanical tracking control of the plurality of receive blocks 11-1 to 11-n based on a signal from the inertial navigation system 13 and the signal from the orbit data processor 15, and for sending the generated electric signal to a driving mechanism 17 mechanically connected to the plurality of receive blocks 11-1 to 11-n, and reference numeral 18 denotes a receiver for receiving a satellite broadcast based on an output of the common-mode synthesizer 12.

Each of the plurality of receives blocks 11-1 to 11-n shown in FIG. 10 includes a flat antenna and a BS converter. Each receive block receives an electric wave from the satellite by way of its antenna and then converts the electric wave received to a first intermediate-frequency signal with its BS converter. The common-mode synthesizer 12 converts each of a plurality of first intermediate-frequency signals from the plurality of receives blocks 11-1 to 11-n to a second intermediate-frequency signal, and then synthesizes a plurality of a second intermediate-frequency signals to generate a composite signal after making them in phase with each other and outputs the composite signal to the receiver 18.

On the other hand, the tracking control unit 16 generates a signal used to control the mechanical tracking of the antenna of each of the plurality of receive blocks 11-1 to 11-n based on an electrical signal from the inertial navigation system 13 installed in the mobile body, which indicates navigation information (i.e., motion information on a motion of the mobile body), and the electrical signal generated by the orbit data processor 15 based on the orbit data 14 on the broadcasting satellite which was input from the outside of the antenna controller in advance, and the tracking control unit 16 then sends the generated signal to the driving mechanism 17. The driving mechanism 17 directs the antenna of each of the plurality of receive blocks 11-1 to 11-n toward the broadcasting satellite according to the signal used for mechanical tracking control from the tracking control unit 16. The prior rat antenna controller can thus excellently receive electric waves from the broadcasting satellite whether the mobile body, such as an aircraft, including the controller has an arbitrary attitude, by controlling the mechanical tracking of the antenna of each of the plurality of receive blocks 11-1 to 11-n.

By the way, it is necessary to mount active devices included in the antenna controller in a place of the mobile body where the best possible operating condition is ensured, for instance, a pressure cabin in the case of an aircraft, from the viewpoint of reliability. The prior art antenna controller as shown in FIG. 10 thus omits a circuit for detecting the direction in which electric waves are coming, which is part of an active device, by using motion information output from the existing inertial navigation system 13, thus simplifying the antenna controller and improving the reliability of the apparatus.

A problem with the prior art antenna controller constructed as above is that although it is possible to direct the antenna beam toward the broadcasting satellite when the beamwidth of the antenna of each of the plurality of receive blocks is relatively large, it is impossible to direct the antenna beam toward the broadcasting satellite with a high degree of accuracy when the beamwidth of the antenna of each receive block is small because a delay of motion information output from the inertial navigation system negatively affects the tracking accuracy.

In general, information output from the inertial navigation system has an uncertain delay. Assuming that motion information on the true bearing from the inertial navigation system has a delay of 100 msec when the mobile body is an aircraft, if the mobile body inclines rapidly in 30 degrees/s with respect to the true bearing, an error of 3 degrees or less occurs in the inclination of the aircraft though it depends on the direction of the broadcasting satellite and the update cycle of the inertial navigation system. Then, the prior art antenna controller will be unable to catch the direction of the broadcasting satellite momentarily if the beamwidth of the antenna is about 2 degrees. Even if the prior art antenna controller is equipped with a monopulse tracker, the delay of information output from the inertial navigation system is fatal to the system if it has a small antenna beam width because it is thought that the system cannot deal with rapid occurrence of such errors.

SUMMARY OF THE INVENTION

The present invention is proposed to solve the above-mentioned problem, and it is therefore an object of the present invention to provide an antenna control method of and an antenna controller for estimating a delay of navigation information, i.e., motion information sent from an inertial navigation system, estimating current or future motion information on a mobile body such as an aircraft in consideration of the estimated delay, so as to direct an antenna beam toward a geostationary satellite or a mobile satellite with a high degree of accuracy.

In accordance with an aspect of the present invention there is provided an antenna control method for controlling a direction of an antenna beam of an antenna unit installed in a mobile body, for a purpose of satellite communication or satellite broadcast reception using a satellite, the method comprising the steps of: in order to estimate a delay of motion information on a motion of the mobile body which is acquired by an inertial navigation system, separately acquiring motion information on the motion of the mobile body; estimating the delay of the motion information acquired by the inertial navigation system based on the motion information separately acquired in the previous step and the motion information acquired by the inertial navigation system; and calculating a direction of the antenna beam in consideration of the estimated delay to direct the antenna beam toward the satellite.

In accordance with another aspect of the present invention, the separately acquiring step is the step of acquiring the motion information on the motion of the mobile body by using a 3-axis angular-velocity sensor.

In accordance with a further aspect of the present invention, the separately acquiring step is the step of acquiring the motion information on the motion of the mobile body by using a 3-axis magnetic bearing sensor.

In accordance with another aspect of the present invention, there is provided an antenna controller for controlling a direction of an antenna beam of an antenna unit, which is installed in a mobile body, for receiving an electric wave from a geostationary satellite, for a purpose of satellite communication or satellite broadcast reception using the geostationary satellite, the antenna controller comprising: an antenna beam control unit for controlling the direction of the antenna beam of the antenna unit; an inertial navigation system for acquiring motion information on a motion of the mobile body; an antenna beam direction calculation unit for calculating the direction of the antenna beam based on the motion information from the inertial navigation system to direct the antenna beam toward the geostationary satellite; a motion information acquisition unit for separately acquiring motion information on the motion of the mobile body; and a motion estimation unit for estimating a delay of the motion information acquired by the inertial navigation system based on the motion information acquired by the inertial navigation system and the motion information acquired by the motion information acquisition unit, and for estimating motion information to be sent to the antenna beam direction calculation unit in consideration of the estimated delay.

In accordance with a further aspect of the present invention, the motion information acquisition unit has a 3-axis angular-velocity sensor.

In accordance with a further aspect of the present invention, there is provided an antenna controller for controlling a direction of an antenna beam of an antenna unit, which is installed in a mobile body, for receiving an electric wave from a mobile satellite, for a purpose of satellite communication or satellite broadcast reception using the mobile satellite, the antenna controller comprising: an antenna beam control unit for controlling the direction of the antenna beam of the antenna unit; an inertial navigation system for acquiring motion information on a motion of the mobile body; an antenna beam direction calculation unit for calculating the direction of the antenna beam based on the motion information from the inertial navigation system to direct the antenna beam toward the mobile satellite; a satellite position information generation unit for generating position information on the mobile satellite from one minute to the next and for sending the position information to the antenna beam direction calculation unit; a motion information acquisition unit for separately acquiring motion information on the motion of the mobile body; and a motion estimation unit for estimating a delay of the motion information acquired by the inertial navigation system based on the motion information acquired by the inertial navigation system and the motion information acquired by the motion information acquisition unit, and for estimating motion information to be sent to the antenna beam direction calculation unit in consideration of the estimated delay.

In accordance with another aspect of the present invention, the motion information acquisition unit has a 3-axis angular-velocity sensor.

In accordance with a further aspect of the present invention, the motion information acquisition unit has a 3-axis magnetic bearing sensor.

Accordingly, the antenna controller according to the present invention can direct the antenna beam of the antenna unit toward either a geostationary satellite or a mobile satellite with a high degree of accuracy.

Further objects and advantages of the present invention will be apparent from the following description of the preferred embodiments of the invention as illustrated in the accompanying drawings.

BRIEF DESCRIPTION OF THE DRAWINGS

FIGS. 3(*a*) to 3(*c*) are timing charts showing a relationship among an angular velocity with respect to X axis, which is measured by the 3-axis angular-velocity sensor, integration of the angular velocity, i.e., an angle around the X axis, and an angle around the X axis, which is measured by an inertial navigation system when an aircraft including the antenna controller of the first embodiment has started switching from a straight movement to a right-hand turn;

FIG.4 is a diagram showing a relationship among an estimation value of motion data calculated by a motion estimation unit of the antenna controller based on the latest motion data, previous motion data preceding the latest motion data by 5 steps, and other previous motion data preceding the latest motion data by 10 steps, the latest motion data, the previous motion data preceding the latest motion data by 5 steps, and the other previous motion data preceding the latest motion data by 10 steps;

DETAILED DESCRIPTION OF THE PREFERRED EMBODIMENTS

Embodiment 1.

Figure 1:
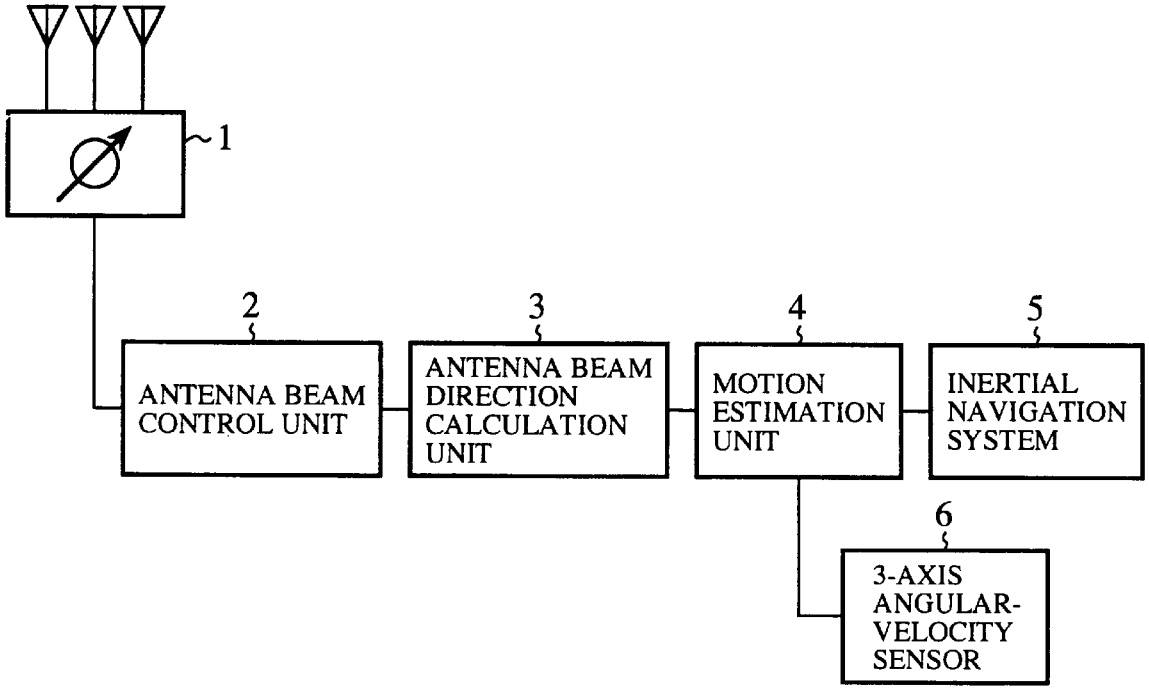
FIG. 1 is a block diagram showing the structure of an antenna controller according to a first embodiment of the present invention.

FIG. 1 is a block diagram showing the structure of an antenna controller according to a first embodiment of the present invention. In the figure, reference numeral 1 denotes an antenna unit for receiving an electric wave from a geostationary satellite, reference numeral 2 denotes an antenna beam control unit for controlling the direction of an antenna beam of the antenna unit 1, reference numeral 3 denotes an antenna beam direction calculation unit for calculating the direction of the antenna beam so as to direct the antenna beam of the antenna unit 1 toward the geostationary satellite, reference numeral 4 denotes a motion estimation unit for estimating motion data on a motion of a mobile body, such as an aircraft, which should be sent to the antenna beam direction calculation unit 3, reference numeral 5 denotes an inertial navigation system installed in the mobile body, for acquiring motion data on a motion of the mobile body, and reference numeral 6 denotes a 3-axis angular-velocity sensor for measuring three angular velocities of the mobile body with resect to the three axes of the mobile body. The antenna controller according to the first embodiment of the present invention can be installed in the mobile body such as an aircraft. In the following, for simplicity, assume that the antenna controller is installed in an aircraft.

Figure 2:
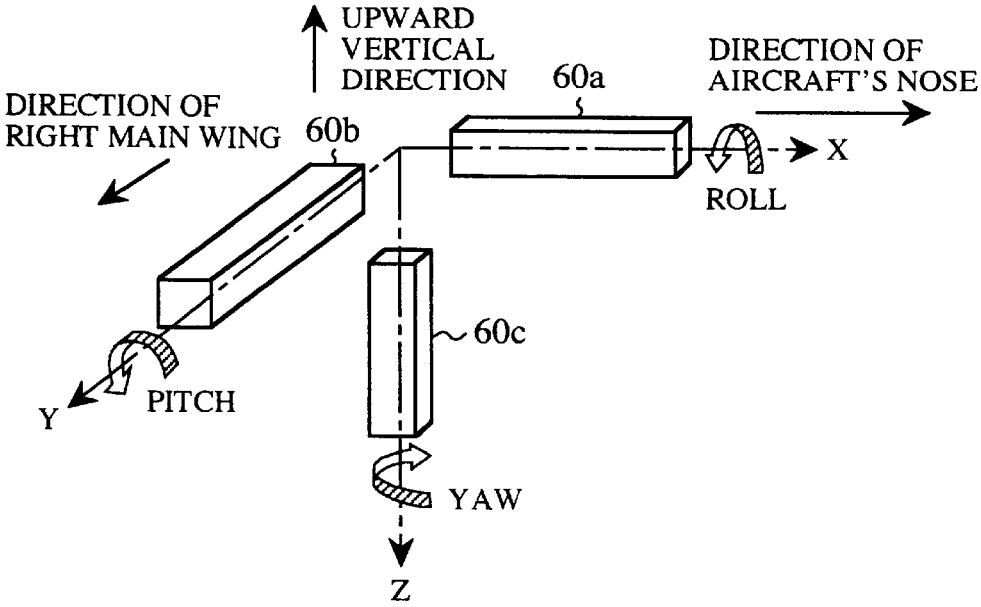
FIG. 2 is a perspective view showing the structure of a 3-axis angular-velocity sensor of the antenna controller according to the first embodiment of the present invention.

FIG. 2 is a diagram showing the structure of the 3-axis angular-velocity sensor 6. A cheap vibration giro which outputs an analog voltage proportional to an angular velocity can be used as each of three angular-velocity sensors shown in FIG. 2 to reduce the cost of the entire apparatus. As shown in FIG. 2, the 3-axis angular-velocity sensor 6 includes three angular-velocity sensors 60*a* to 60*c* each of which detects an angular velocity with respect to a corresponding one of the three axes of a right-hand rectangular coordinate system. In FIG. 2, the X axis is parallel to the direction of the axis of the airframe, and the positive direction of the X axis shows the direction of the nose of the airframe. The Y axis is vertical to the airframe axis, and the positive direction of the Y axis shows the direction of the right main wing of the aircraft. The Z axis is parallel to the vertical direction, and the positive direction of the Z axis shows the downward direction. For simplicity, it can be assumed that a 3-axis angular-velocity sensor (not shown in FIG. 2) disposed in the internal navigation system 5 has detection axes similar to those as shown in FIG. 2. The inertial navigation system 5 outputs data indicating the true bearing of the aircraft, i.e., the direction of the airframe around the vertical axis, as described later.

The inertial navigation system 5 discretely outputs motion data on the aircraft, which is accurate but has a delay, i.e., data on an angle around X axis of the airframe (i.e., roll), an angle around the Y axis of the airframe (i.e., pitch), and an angle around the Z axis of the airframe (i.e., yaw). On there other hand, since motions of the aircraft are very slow with respect to the response characteristic of each of the three angular-velocity sensors included in the 3-axis angular-velocity sensor 6, and therefore each angular-velocity sensor can output motion data with a delay which is so small that it may be ignored, it can be assumed that each angular-velocity sensor to be a device for continuously outputting angular velocity data on a corresponding accurate angular velocity of the aircraft without any delay. However, while each angular-velocity sensor included in the 3-axis angular-velocity sensor 6 outputs an analog voltage as the angular velocity data, the 3-axis angular-velocity sensor 6 analog—to—digital converts the analog voltage output from each angular-velocity sensor and then outputs equivalent digital data. Accordingly, each angular velocity data output from the 3-axis angular-velocity sensor 6 can be estimated to have generally a delay of one sampling period of the analog—to—digital conversion.

FIGS. 3(*a*) to 3(*c*) are timing charts showing a relationship among output data from the angular-velocity sensor 60*a*, i.e., the angular velocity with respect to the X axis, integration of the output data from the angular-velocity sensor 60*a*, i.e., an angle around the X axis by which the aircraft has rolled, and output data on the roll output from the inertial navigation system 5, when the aircraft has started switching from a straight movement to a right-hand turn. The time bases of these FIGS. 3(*a*) to 3(*c*) are matched to each other. As can be seen from FIGS. 3(*a*) to 3(*c*), the delay Δt of the output data on the roll output from the inertial navigation system 5 shown in FIG. 3(*c*) can be measured based on FIG. 3(*b*) showing the integration of the output data from the angular-velocity sensor 60*a*. By the way, as previously mentioned, since the output of the angular-velocity sensor 60*a* shown in FIG. 3(*a*) is estimated to include a delay of one sampling period of the analog—to—digital conversion, it is assumed that the output data on the roll output from the inertial navigation system 5 shown in FIG. 3(*c*) actually has a total delay DT equal to (Δt+one sampling period of the analog—to—digital conversion).

In operation, the inertial navigation system 5 acquires motion data on the aircraft by using a 3-axis angular-velocity sensor (not shown in the figure) disposed therein, and sends it to the motion estimation unit 4. On the other hand, the 3-axis angular-velocity sensor 6 outputs angular velocity data on the three angular velocities around the X, Y, and Z axes measured by the three angular-velocity sensors 60*a* to 60*c* to the motion estimation unit 4. Each angular velocity data on the angular velocity with respect to the X, Y, or Z axis is estimated to have a delay of one sampling period of the analog—to—digital conversion, as previously mentioned.

The motion estimation unit 4 estimates the delay of the motion data on the angle around the X axis output from the inertial navigation system 5, that of the motion data on the angle around the Y axis, and that of the motion data on the angle around Z axis by using the angular velocity data on the three angular velocities around the X, Y, and Z axes measured by the three angular-velocity sensors 60*a* to 60*c* of the 3-axis angular-velocity sensor 6, and then estimates current or future motion data on a motion of the aircraft in consideration of the estimated delay of the motion data.

Concretely, the motion estimation unit 4 estimates the delay DT of the motion data on the angle around the X axis sent from the inertial navigation system 5 as follows. As shown in FIGS. 3(*a*) to 3(*c*), when the output data on the angle around the X axis from the inertial navigation system 5 shown 0 degrees, the motion estimation unit 4 sets the angular velocity data measured by the angular-velocity sensor 60*a* with respect to the X axis of the 3-axis angular-velocity sensor 6 to 0 degrees/s and sets the integral value of the angular velocity data to 0 degrees. And, the motion estimation unit 4 starts the integration of the output data of the angular-velocity sensor 60*a* at a certain time $t_0$, and determines that the time when the integral value reaches 5 degrees is $t_1$ and also determines that the time when the output data on the angle around the X axis from the inertial navigation system 5 reaches 5 degrees is $t_2$. The motion estimation unit 4 thus determines Δt ($=t_2-t_1$) included in the total delay DT of the motion data on the angle around the X axis, and adds a delay of one sampling period of the analog—to—digital conversion to Δt so as to calculate the total delay DT.

The motion estimation unit 4 determines the above-mentioned time $t_0$ as follows. The motion estimation unit 4 goes back from a certain time (i.e., $t_0$), as shown is FIGS. 3(*a*) in 3(*c*), and then determines whether the output data on the angle around the X axis from the inertial navigation system 5 and the output data of the angular-velocity sensor 60*a* have constant values (0 in the above-mentioned case), respectively, during Ts seconds. If so, the motion estimation unit 4 sets the above-mentioned time to $t_0$. The fact that one output of the inertial navigation system 5 concerning the angle around one detection axis has a constant value during Ts seconds indicates that the airframe does not rotate about the detection axis. However, since, as previously mentioned, every output data of the inertial navigation system 5 has a delay, the motion estimation unit 4 determines the above-mentioned time $t_0$ while additionally determining whether the output data from the angular-velocity sensor 60*a* has not changed for a certain time period.

As an alternative, the motion estimation unit 4 can estimate the total delay DT of the motion data on the angle around the X axis sent from the inertial navigation system 5 as follows. As previously mentioned, while the inertial navigation system 5 discretely outputs motion data, which is accurate but has a delay, i.e., data on the angle around the X axis of the airframe, the 3-axis angular-velocity sensor 6 continuously outputs the angular velocity data on an accurate angular velocity with respect to the X axis of the airframe, which has a delay of one sampling period of and analog—to—digital conversion. The motion estimation unit 4 determines a fitting curve from the output data on the angle around the X axis discretely output from the inertial navigation system 5 by using a method of least squares, and calculates an offset with respect to the time base by comparing the fitting curve with the integration of the output data on the angular-velocity sensor 6. This offset is equal to Δt included in the total delay DT of the motion data on the angle around the X axis. The motion estimation unit 4 can do the arithmetic processing in real time. Instead of doing the arithmetic processing in real time, the motion estimation unit 4 can do it later.

In this way, the motion estimation unit 4 estimates a delay of output data on the roll from the inertial navigation system 5. The motion estimation unit 4 also estimates a delay of output data on the pitch from the inertial navigation system 5 by comparing it with the integrations of the output data on the angular velocity with respect to the Y axis from the 3-axis angular-velocity sensor 6 in the same way. However, since in general the output data on the angle around the Z axis of the airframe from the inertial navigation system 5 indicates the true bearing, i.e., the bearing around the vertical axis of the airframe, the motion estimation unit 4 cannot simply compare the output data on the angle around the Z axis from the inertial navigation system 5 with the integration of the angular velocity data around the Z axis from the 3-axis angular-velocity sensor 6. Then, the motion estimation unit 4 performs coordinate transformation of the angular velocity data around the Z axis from the 3-axis angular-velocity sensor 6 to angular velocity data around the vertical axis of the airframe, and then integrates the angular velocity data. The motion estimation unit 4 compares the integration of the angular velocity data around the vertical axis with the output data on the true bearing from the inertial navigation system 5, and estimates the delay of the output data on the true bearing from the inertial navigation system 5.

The motion estimation unit 4 can perform the estimation of the delay of each output data of the inertial navigation system 5 only once after the startup of the antenna controller. As an alternative, the motion estimation unit 4 performs the estimation of the delay at predetermined time intervals and calculates the average of some estimated delays, and then determines the average value as an estimation value of the delay. In the latter case, the accuracy of the estimation of the delay can be improved.

When the motion estimation unit 4 thus estimates the delay of each output data on the roll, pitch, or true bearing of the aircraft from the inertial navigation system 5, it performs estimation calculations of current or future motion data by using the latest motion data obtained by correcting the measurement time of the output data on the roll, pitch, and true bearing output from the inertial navigation system 5 in consideration of the delay estimated as mentioned above, and previous motion data obtained by correcting the measurement time of previous output data on the roll, pitch, and true bearing output from the inertial navigation system 5 in the same way.

The motion estimation unit 4 can approximate current or future motion data by extrapolation calculation of a quadratic function given by the following equation (1):

$$y=at^2+bt+c \tag{1}$$

where $a=\{-(x_1-x_0)y_2-(x_0-x_2)\ y_1-(x_2-x_1)\ y_0\}/\{(x_2-x_1)(x_1-x_0)\ (x_0-x_2)\}$, $b=\{y_2-y_1-a\ (x_2^2-x_1^2)\}/(x_2-x_1)$, $c=y_0-ax_0^2-bx_0$, y is an estimation value (degree) of one motion data (i.e., data on the roll, pitch, or true bearing of the aircraft), t is equal to (current or future time T—current time $T_c$) (sec), $y_0$ is the latest value (degree) of the above-mentioned motion data, $x_0$ is equal to (the measurement time $T_0$ of the latest value-the current time $T_c$), i.e., -(the delay DT of the above-mentioned motion data) (when the latest value is a current output), $y_1$ is a previous value (degree) of the above-mentioned motion data which precedes the latest value $y_0$ by 5 steps, and $x_1$ is equal to (the measurement time $T_1$ of the previous value $y_1$ preceding the latest value $y_0$ by 5 steps—the current time $T_c$) (sec), and $y_2$ is another previous value (degree) of the above-mentioned motion data which precedes the latest value $y_0$ by 10 steps, and $x_2$ is equal to (the measurement time $T_2$ of the other previous value $y_2$ preceding the latest value $y_0$ by 10 steps—the current time $T_c$) (sec). The measurement times $T_1$ $T_2$ have been corrected in consideration of the estimated total delay DT. FIG. 4 is a diagram showing a relationship among the latest motion data $y_0$, the previous motion data $y_1$ preceding the latest motion data $y_0$ by 5 steps, the other previous motion data $y_2$ preceding the latest motion data $y_0$ by 10 steps, and the estimation value y.

Thus, the motion estimation unit 4 can calculate an estimation y of the motion data which precedes a current one by only a time $t(\geqq 0)$ by using the latest data $y_0$, the previous data $y_1$ preceding the latest data $y_0$ by 5 steps, the other previous data $y_2$ preceding the latest data $y_0$ by 10 steps. The motion estimation unit 4 calculates estimations for the roll, pitch, and true bearing of the aircraft independently, according to above-mentioned equation (1), and outputs the estimations to the antenna beam direction calculation unit 3. The motion estimation unit 4 can alternatively estimate future or current motion data according to any other function which can approximately changes in the motion data instead of a quadratic function given by the above-mentioned equation (1).

The antenna beam direction calculation unit 3 calculates an antenna beam direction of the antenna unit 1 to direct the antenna beam of the antenna unit 1 toward the geostationary satellite based on information on the latitude and longitude of the geostationary satellite, information on the latitude and longitude of the aircraft, and output data on the roll, pitch, and true bearing of the aircraft from the motion estimation unit 4. The antenna beam control unit 2 then calculates phase data used to form the antenna beam based on the antenna beam direction calculated by the antenna beam direction calculation unit 3, and sends the phase data to the antenna unit 1. The antenna unit 1 forms the antenna beam based on the phase data sent from the antenna beam control unit 2, and directs the antenna beam of the antenna unit 1 toward the geostationary satellite.

As mentioned above, in accordance with the first embodiment of the present invention, even if output data of the existing inertial navigation system 5 installed in a mobile body, such as an aircraft, has a delay and the antenna has a small beamwidth, since the antenna controller estimates a delay of the motion data measured by the inertial navigation system 5 by using motion data acquired by the 3-axis angular-velocity sensor 6 and then corrects the measurement time of the motion data from the inertial navigation system 5 in consideration of the estimated delay and estimates future or current motion data, the antenna controller can direct the antenna beam of the antenna unit 1 toward the geostationary satellite with a high degree of accuracy.

In order to improve the accuracy further, closed loop tracking such as monopulse tracking or step tracking can be applied to the antenna controller according to the first embodiment of the present invention.

In the above description, it is assumed that the antenna of the antenna controller of the first embodiment is an electronic—control—type one. However, the antenna can be a mechanical—drive—type one, and this case can offer the same advantage. In this case, the antenna beam control unit 2 is adapted to control a motor based on the antenna beam direction calculated by the antenna beam direction calculation unit 3 and drive the antenna unit 1 so as to direct the antenna beam of the antenna unit 1 toward the geostationary satellite.

Furthermore, although it is assumed that the inertial navigation system 5 has the detection axes as shown in FIG. 2 in the first embodiment, for simplicity, a relationship between the direction axes of the inertial navigation system 5 and those of the 3-axis angular-velocity sensor 6 only has to be already known and the antenna controller only has to be able to do comparison between the motion data from the inertial navigation system 5 and the motion data from the 3-axis angular-velocity sensor 6 by performing coordinate transformation. Therefore, matching the detection axes of the inertial navigation system 5 to those of the 3-axis angular-velocity sensor 6 is not a limitation imposed on the present invention.

Embodiment 2

Figure 5:
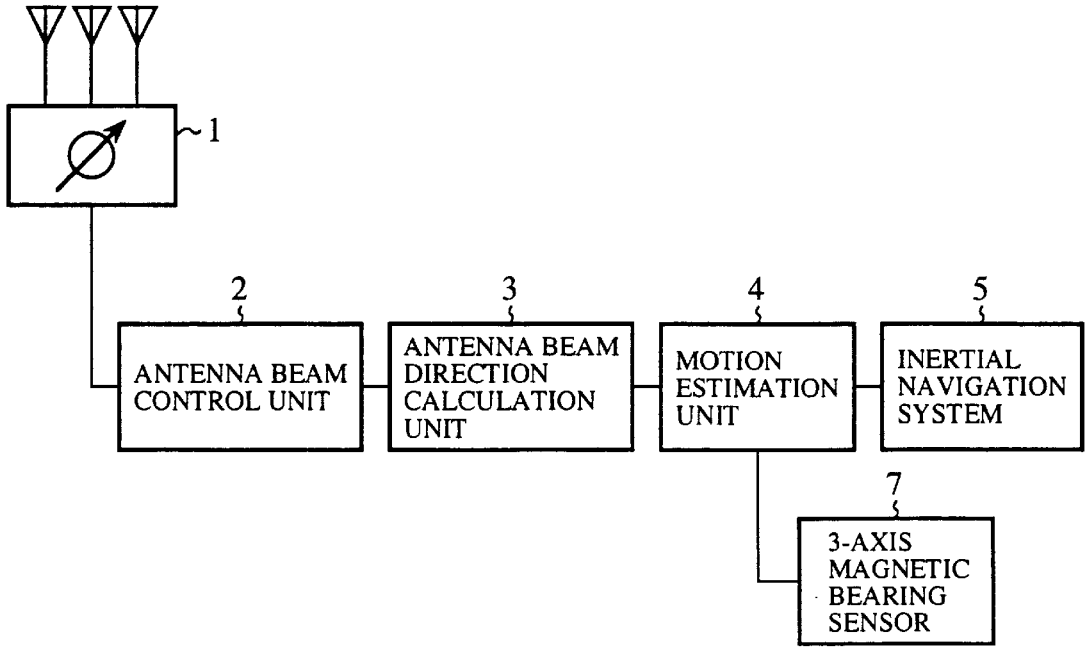
FIG. 5 is a block diagram showing the structure of an antenna controller according to a second embodiment of the present invention.

FIG. 5 is a block diagram showing the structure of an antenna controller according to a second embodiment of the present invention. In the figure, the same components as those of the antenna controller according to the above-mentioned first embodiment are designated by the same reference numerals as shown in FIG. 1, and therefore the explanation of those components will be omitted hereafter. Furthermore, in FIG. 5, reference numeral 7 denotes a 3-axis magnetic bearing sensors for detecting three components of the geomagnetic vector in the directions of three axes of a mobile body. The antenna controller according to the second embodiment has the 3-axis magnetic bearing sensor 7 instead of a 3-axis angular-velocity sensor 6 as shown in FIG. 1. The antenna controller according to the second embodiment of the present invention can be installed in the mobile body such as an aircraft. In the following, for simplicity, assume that the antenna controller is installed in an aircraft.

Figure 6:
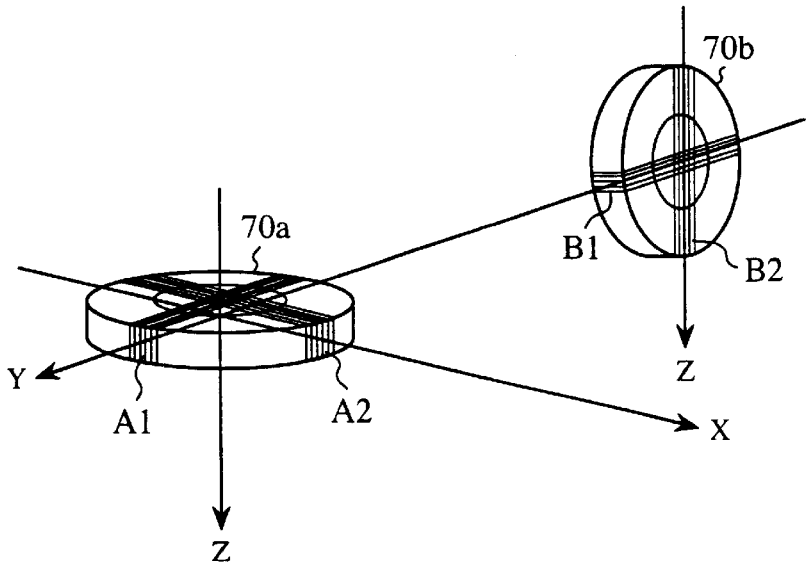
FIG. 6 is a perspective view showing the structure of a 3-axis magnetic bearing sensor of the antenna controller according to the second embodiment of the present invention.

FIG. 6 is a diagram showing the structure of the 3-axis magnetic bearing sensor 7. As shown in FIG. 6, the 3-axis magnetic bearing sensor 7 includes two magnetic bearing sensors 70*a* and 70*b* each of which detects two components of the geomagnetic vector in the directions of two of the three axes of a right-hand rectangular coordinate system. Each of the two magnetic bearing sensor 70*a* and 70*b* is a magnetic bearing sensor of flux gate type for detecting two components of the geomagnetic vector by measuring voltages excited in two coils thereof which are orthogonal to each other. The 3-axis magnetic bearing sensor 7 is so constructed as to detect three components of the geomagnetic vector in the directions of the three axes of a right-hand rectangular coordinate system as shown in FIG. 6 by using the two magnetic bearing sensors 70*a* and 70*b*.

In FIG. 6, the X axis is parallel to the direction of the axis of the airframe, and the positive direction of the X axis shows the direction of the nose of the airframe. The Y axis is vertical to the airframe axis, and the positive direction of the Y axis shows the direction of the right main wing of the aircraft. The Z axis is parallel to the vertical direction, and the positive direction of the Z axis shows the downward direction. For simplicity, it can be assumed that an inertial navigation system 5 has detection axes similar to those as shown in FIG. 6. The inertial navigation system 5 outputs data indicating the true bearing of the aircraft, i.e., the direction of the airframe around the vertical axis, as described later.

In the 3-axis magnetic bearing sensor 7 constructed as shown in FIG. 6, a coil A1 of the magnetic bearing sensor 70*a* detects a component of the geomagnetic vector in the direction of the X axis, and both of another coil A2 of the magnetic bearing sensor 70*a* and a coil B2 of the magnetic bearing sensor 70*b* detect a component of the geomagnetic vector in the direction of the Y axis. Another coil B1 of the magnetic bearing sensor 70*b* detects a component of the geomagnetic vector in the direction of the Z axis. Since both the coil A2 of the magnetic bearing sensor 70*a* and the coil B2 of the magnetic bearing sensor 70*b* detect the same physical value, the gains of the two magnetic bearing sensor 70*a* and 70*b* are adjusted so that the output of the coil A2 has the same value as that of the coil B2.

As previously mentioned, the inertial navigation system 5 discretely outputs motion data on the aircraft, which is accurate but has a delay, i.e., data on the roll, pitch, and true bearing of the aircraft. On the other hand, since motions of the aircraft are very slow with respect to the response characteristic of each magnetic bearing sensor included in the 3-axis magnetic bearing sensor 7, and therefore each magnetic bearing sensor can output motion data with a delay which is so small that it may be ignored, it can be assumed that each magnetic bearing sensor to be a device for continuously outputting data on a corresponding accurate component of the geomagnetic vectors in the direction of one of the X, Y, and Z axes of the airframe without any delay. However, while each magnetic bearing sensor included in the 3-axis magnetic bearing sensor 7 outputs an analog voltage as data on a corresponding component of the geomagnetic vector, the 3-axis magnetic bearing sensor 7 analog—to—digital converts the analog voltage output from each magnetic bearing sensor and then outputs equivalent digital data. Accordingly, each data on a corresponding component of the geomagnetic vector output from the 3-axis magnetic bearing sensor 7 can be estimated to have generally a delay of one sampling period of the analog—to—digital conversion. Since integration of output data of the 3-axis magnetic bearing sensor, which will generate a steady output, exerts a bad influence upon the response characteristic of the 3-axis magnetic bearing sensor 7, no integration is performed on the output data of the 3-axis magnetic bearing sensor 7.

Figure 7A:
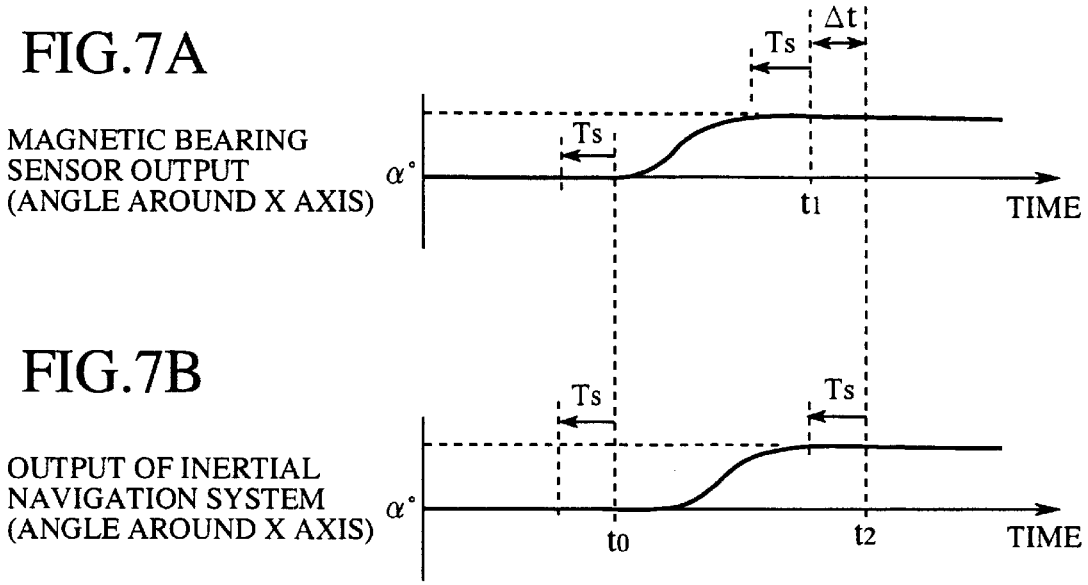
FIGS. 7(*a*) and 7(*b*) are timing charts showing a relationship among an angle around the X axis, which is measured by the 3-axis magnetic bearing sensor, and an angle around the X axis, which is measured by an inertial navigation system, when an aircraft including the antenna controller of the second embodiment has started switching from a straight movement to a right-hand turn.

FIGS. 7(*a*) and 7(*b*) are timing charts showing a relationship among the angle around the X axis which is calculated based on the output data from the 3-axis magnetic bearing sensor 7, and output data on the roll output from the inertial navigation system 5, when the aircraft has started switching from a straight movement to a right-hand turn. The time bases of FIGS. 7(*a*) and 7(*b*) are matched to each other. The angle around the X axis calculated from the output data of the 3-axis magnetic bearing sensor 7 is defined as the angle which the geomagnetic vector detected by the coils A1, A2, and B1 in FIG. 6 form with the XY plane. Although the vertical component of the geomagnetism is not 0 everywhere on the earth, the above-mentioned definition does not cause any problem because an offset is added to the output data of the 3-axis magnetic bearing sensor 7 so that the output data of the 3-axis magnetic bearing sensor 7 is matched to the corresponding output data of the inertial navigation system 5 when the output data of the inertial navigation system 5 has a constant value (i.e., because the output data of the 3-axis magnetic bearing sensor 7 is handled only as a relative value), as described below.

As can be seen from FIGS. 7(*a*) and 7(*b*), the delay $\Delta t$ of the output data on the roll output from the inertial navigation system 5 shown in FIG. 7(*b*) can be measured based on FIG. 7(*a*) showing the angle around the X axis which is calculated based on the output data from the 3-axis magnetic bearing sensor 7. By the way, as previously mentioned, since the output data from the 3-axis magnetic bearing sensor 7 shown in FIG. 7(*a*) is estimated to include a delay of one sampling period of the analog—to—digital conversion, it is assumed that the output data on the roll output from the inertial navigation system 5 shown in FIG. 7(*b*) actually has a total delay DT equal to ($\Delta t$+one sampling period of the analog–to—digital conversion).

In operation, the inertial navigation system 5 acquires motion data on the aircraft by using a 3-axis angular-velocity sensor (not shown in the figure) disposed therein, and sends it to a motion estimation unit 4. On the other hand, the 3-axis magnetic bearing sensor 7 outputs data on the three components of the geomagnetic vector in the directions of the three axes of the aircraft measured by the two magnetic bearing sensor 70*a* and 70*b* to the motion estimation unit 4. Each data on a geomagnetic vector component in the direction of the X, Y, or Z axis from the 3-axis magnetic bearing sensor 7 is estimated to have a delay of one sampling period of the analog—to—digital conversion, as previously mentioned.

The motion estimation unit 4 estimates the delay of the motion data on the angle around the X axis output from the inertial navigation system 5, that of the motion data on the angle around the Y axis, and that of the motion data on the angle around Z axis by using the data on the three components of the geomagnetic vector in the directions of the X, Y, and Z axes of the aircraft measured by the two magnetic bearing sensor 70*a* and 70*b*, and then estimates current of future motion data on the aircraft in consideration of the estimated delay of the motion data.

Concretely, the motion estimation unit 4 estimates the total delay DT of the motion on the angle around the X axis sent from the inertial navigation system 5 as follows. As shown in FIGS. 7(*a*) and 7(*b*), when the output data on the angle around the X axis from the inertial navigation system 5 shows $\alpha$ degrees, the motion estimation unit 4 sets the angle around the X axis calculated from the output data on the 3-axis magnetic bearing sensor 7 to $\alpha$ degrees by adding the offset to the angle around the X axis. And, the motion estimation unit 4 sets a predetermined time $t_0$, and determined that the time when the output data of the inertial navigation system 5 starts to remain unchanged after it has started changing is $t_2$. The motion estimation unit 4 also determines that the time when the angle around the X axis calculated from the output data of the 3-axis magnetic bearing sensor 7 starts to remain unchanged after it has started changing is $t_1$. Thus, the motion estimation unit 4 determines $\Delta t$ ($=t_2-t_1$) included in the total delay DT of the motion data on the angle around the X axis, and adds a delay of one sampling period of the analog—to—digital conversion to $\Delta t$ so as to calculate the total delay DT.

The motion estimation unit 4 determines the above-mentioned time $t_0$ as follows. The motion estimation unit 4 goes back from a certain time (i.e., $t_0$) as shown in FIGS. 7(*a*) and 7(*b*), and then determines whether the output data on the angle around the X axis from the inertial navigation system 5 and the angle around the X axis calculated from the output data of the 3-axis magnetic bearing sensor 7 have constant values ($\alpha$ degrees in the above-mentioned case), respectively, during Ts seconds. If so, the motion estimation unit 4 sets the above-mentioned time to $t_0$. The fact that one output of the inertial navigation system 5 concerning the angle around one detection axis has a constant value during Ts seconds indicates that the airframe does not rotate about the detection axis. However, since, as previously mentioned, the output data of the inertial navigation system 5 has a delay, the motion estimation unit 4 determines the above-mentioned time $t_0$ while additionally determining if the angle around the X axis calculated from the output data from the 3-axis magnetic bearing sensor 7 has remained unchanged for a certain time period. In the example shown in FIGS. 7(*a*) and 7(*b*), after the motion estimation unit 4 has set the time $t_0$ as mentioned above, the angle around the X axis calculated from the output data of the 3-axis magnetic bearing sensor 7 starts to change, and the output data on the angle around the X axis from the inertial navigation system 5 also starts to change. When detecting such a change, the motion estimation unit 4 determines $\Delta t$ ($=t_2-t_1$) included in the total delay DT of the motion data on the angle around the X axis as follows. First of all, the motion estimation unit 4 goes back from a certain time and determines whether the angle around the X axis calculated from the output data of the 3-axis magnetic bearing sensor 7 has started changing and, after that, had a constant value, and has remained unchanged during Ts seconds. The motion estimation unit 4 sets the above-mentioned time to $t_1$ if the data on the angle around the X axis has remained unchanged during Ts seconds. Similarly, the motion estimation unit 4 goes back from another certain time and determines whether the output data on the angle around the X axis from the inertial navigation system 5 had started changing and, after that, had a constant value, and has remained unchanged during Ts seconds. The motion estimation unit 4 sets the above-mentioned time to $t_2$ when the data on the angle around the X axis has remained unchanged during Ts seconds. After the startup of the antenna controller according to the second embodiment, the motion estimation unit 4 performs a determination of the times $t_1$ to $t_2$ once. As an alternative, the motion estimation unit 4 can perform such a determination at all times, and can calculate the average of a plurality of estimations of Δt included in the total delay DT of the motion data on the angle around the X axis. As a result, the accuracy of the estimation of Δt can be improved. In this case, the motion estimation unit 4 sets the above-mentioned $t_2$ to a new value of the time $t_0$.

A problem with the second embodiment which employs the 3-axis magnetic bearing sensor 7 is that since the aircraft wears magnetism, the output of the 3-axis magnetic bearing sensor 7 may not change even though the aircraft changes its direction. There is a method of adding an offset to the output of each coil of the 3-axis magnetic bearing sensor 7 to overcome the problem. As an alternative, the 3-axis magnetic bearing sensor 7 can be mounted in a place with little influence of the magnetism of the airframe.

In this manner, the motion estimation unit 4 estimates the delay of the output data on the roll from the inertial navigation system 5. The motion estimation unit 4 also estimates the delay of the output data on the pitch from the inertial navigation system 5 by comparing it with the integration of the output data on the angular velocity with respect to the Y axis from the 3-axis magnetic bearing sensor 7 in the same way. However, since in general the output data on the angle around the Z axis of the airframe from the inertial navigation system 5 indicates the true bearing, i.e., the direction of the airframe around the vertical axis, the motion estimation unit 4 cannot simply compare the output data on the angle around the Z axis measured by the inertial navigation system 5 with the angle around the Z axis calculated from the output data of the 3-axis magnetic bearing sensor 7. Therefore, the motion estimation unit 4 determines the true bearing of the airframe by projecting the geomagnetic vector measured by the 3-axis magnetic bearing sensor 7 onto the XY plane. The motion estimation unit 4 then compares the determined true bearing with the true bearing measured by the inertial navigation system 5, and estimates the delay of the true bearing measured by the inertial navigation system 5.

The motion estimation unit 4 can perform the estimation of the delay of each output data of the inertial navigation system 5 only once after the startup of the antenna controller. As an alternative, the motion estimation unit 4 performs the estimation of the delay at predetermined time intervals and calculates the average of some estimated delays, and then determines the average value as an estimated value of the delay. In the latter case, the accuracy of the estimation of the delay can be improved.

When the motion estimation unit 4 thus estimates the delay of the output data on the roll, pitch, and true bearing of the aircraft from the inertial navigation system 5, it performs estimation calculations of current or future motion data by using the latest motion data obtained by correcting the measurement time of the current output data on the roll, pitch, and true bearing output from the inertial navigation system 5 in consideration of the delay estimated as mentioned above, and previous motion data obtained by correcting the measurement time of previous output data on the roll, pitch, and true bearing output from the inertial navigation system 5 in the same way.

The antenna beam direction calculation unit 3 calculates the direction of the antenna beam of the antenna unit 1 to direct the antenna beam of the antenna unit 1 toward the geostationary satellite based on information on the latitude and longitude of the geostationary satellite, information on the latitude and longitude of the aircraft, and output data on the roll, pitch, and true bearing of the aircraft from the motion estimation unit 4. The antenna beam control unit 2 then calculates phase data used to form the antenna beam based on the antenna beam direction calculated by the antenna beam direction calculation unit 3, and sends the phase data to the antenna unit 1. The antenna unit 1 forms the antenna beam based on the phase data sent from the antenna beam control unit 2, and directs the antenna beam of the antenna unit 1 toward the geostationary satellite.

As mentioned above, in accordance with the second embodiment of the present invention, even if the output data of the existing inertial navigation system 5 installed in a mobile body, such as an aircraft, has a delay and the antenna has a small beamwidth, since the antenna controller estimates the delay of the motion data measured by the inertial navigation system 5 by using motion data calculated from output data of the 3-axis magnetic bearing sensor 7 and then corrects the measurement time of the motion data from the inertial navigation system 5 in consideration of the estimated delay and estimates future or current motion data, the antenna controller can direct the antenna beam of the antenna unit 1 toward the geostationary satellite with a high degree of accuracy.

In order to improve the accuracy further, closed loop tracking such as monopulse tracking or step tracking can be applied to the antenna controller according to the second embodiment of the present invention.

Although it is assumed that the antenna of the antenna controller of the second embodiment is an electronic—control—type one, the antenna can be a mechanical—drive—type one, and this case can offer the same advantage. In this case, the antenna beam control unit 2 is adapted to control a motor based on the antenna beam direction calculated by the antenna beam direction calculation unit 3 and drive the antenna unit 1 so as to direct the antenna beam of the antenna unit 1 toward the geostationary satellite.

Furthermore, although it is assumed that the inertial navigation system 5 has the detection axes as shown in FIG. 2 in the first embodiment, for simplicity, a relationship between the detection axes of the inertial navigation system 5 and those of the 3-axis magnetic bearing sensor 7 only has to be already known and the antenna controller only has to be able to do comparison between the motion data from the inertial navigation system 5 and the motion data calculated from the output of the 3-axis magnetic bearing sensor 7 by performing coordinate transformation. Therefore, matching the detection axes of the inertial navigation system 5 to those of the 3-axis magnetic bearing sensor 7 is not a limitation imposed on the present invention.

Embodiment 3.

Figure 8:
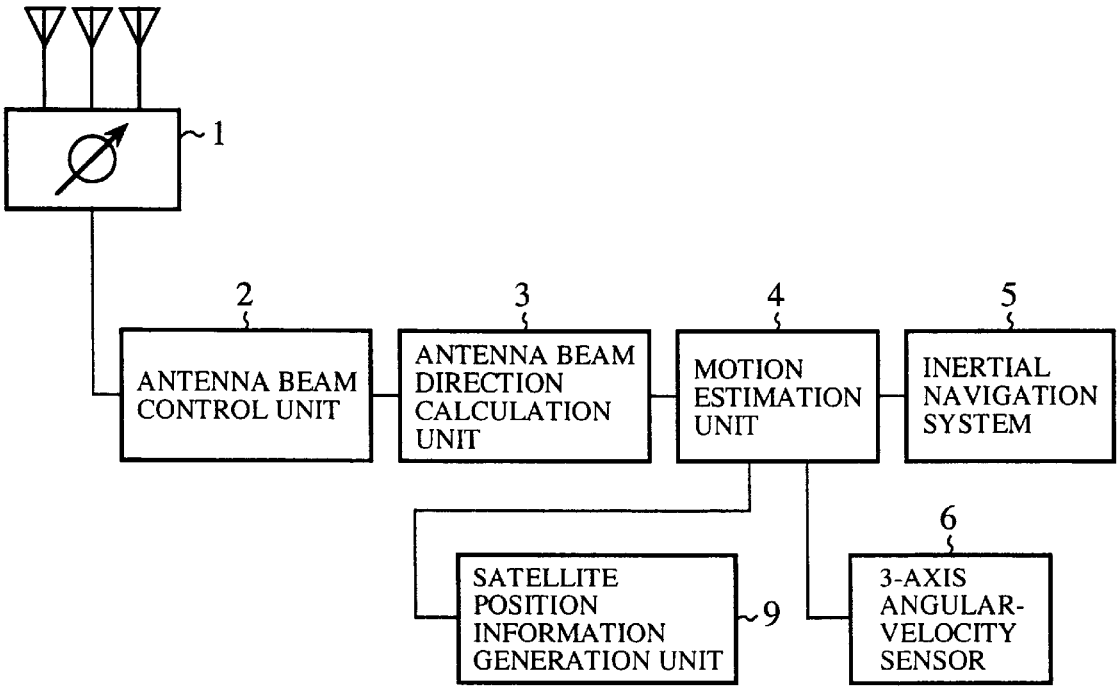
FIG. 8 is a block diagram showing the structure of an antenna controller according to a third embodiment of the present invention.

FIG. 8 is a block diagram showing the structure of an antenna controller according to a third embodiment of the present invention. In the figure, the same components as those of the antenna controller according to the above-mentioned first embodiment are designated by the same reference numerals as shown in FIG. 1, and therefore the explanation of those components will be omitted hereafter. Furthermore, in FIG. 8, reference numeral 9 denotes a satellite position information generation unit for generating position information on the position of a mobile satellite from one minute to the next, and for sending the position information on the mobile satellite generated to an antenna beam direction calculation unit 3, to direct the antenna beam of an antenna unit 1 toward the mobile satellite. The antenna controller according to the third embodiment differs from that according to the above-mentioned first embodiment in that it directs the antenna beam of the antenna unit 1 toward not a geostationary satellite but a mobile satellite. The antenna controller according to the third embodiment can direct the antenna beam of the antenna unit 1 toward another target other than a mobile satellite if it can generate position information on the other target from one minute to the next.

Since a basic operation of the antenna controller according to the third embodiment is the same as that of the antenna controller according to the above-mentioned first embodiment, only part of the operation of the antenna controller which differs from that of the antenna controller according to the first embodiment will be explained hereafter. The satellite position information on the mobile satellite, i.e., the latitude and longitude of the mobile satellite from one minute to the next, and adds a time tag to it before storing it in a built-in memory (not shown in the figure). The satellite position information generation unit 9 then reads the latitude and longitude data from the memory at a predetermined time and outputs the data to an antenna beam direction calculation unit 3.

As mentioned above, in accordance with the third embodiment of the present invention, even if output data of the existing inertial navigation system 5 installed in a mobile body, such as an aircraft, has a delay and the antenna has a small beamwidth, since the antenna controller estimates a delay of the motion data measured by the inertial navigation system 5 by using motion data acquired by a 3-axis angular-velocity sensor 6 and then corrects the measurement time of the motion data from the inertial navigation system 5 in consideration of the estimated delay and estimates future or current motion data, the antenna controller can direct the antenna beam of the antenna unit 1 toward a moving object, such as a mobile satellite, with a high degree of accuracy.

Embodiment 4.

Figure 9:
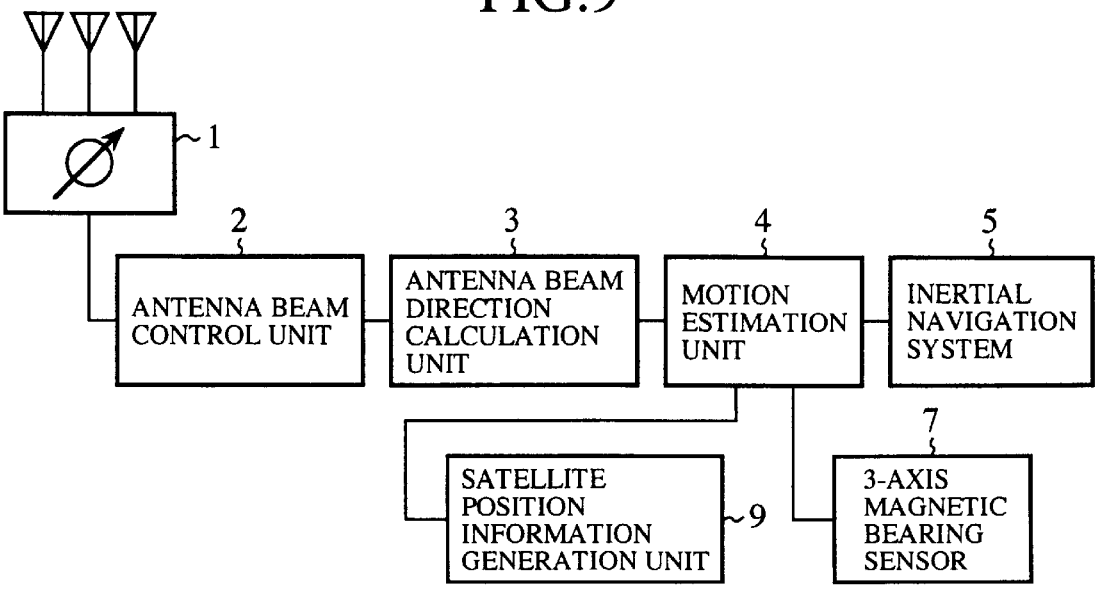
FIG. 9 is a block diagram showing the structure of an antenna controller according to a fourth embodiment of the present invention.
Figure 10:
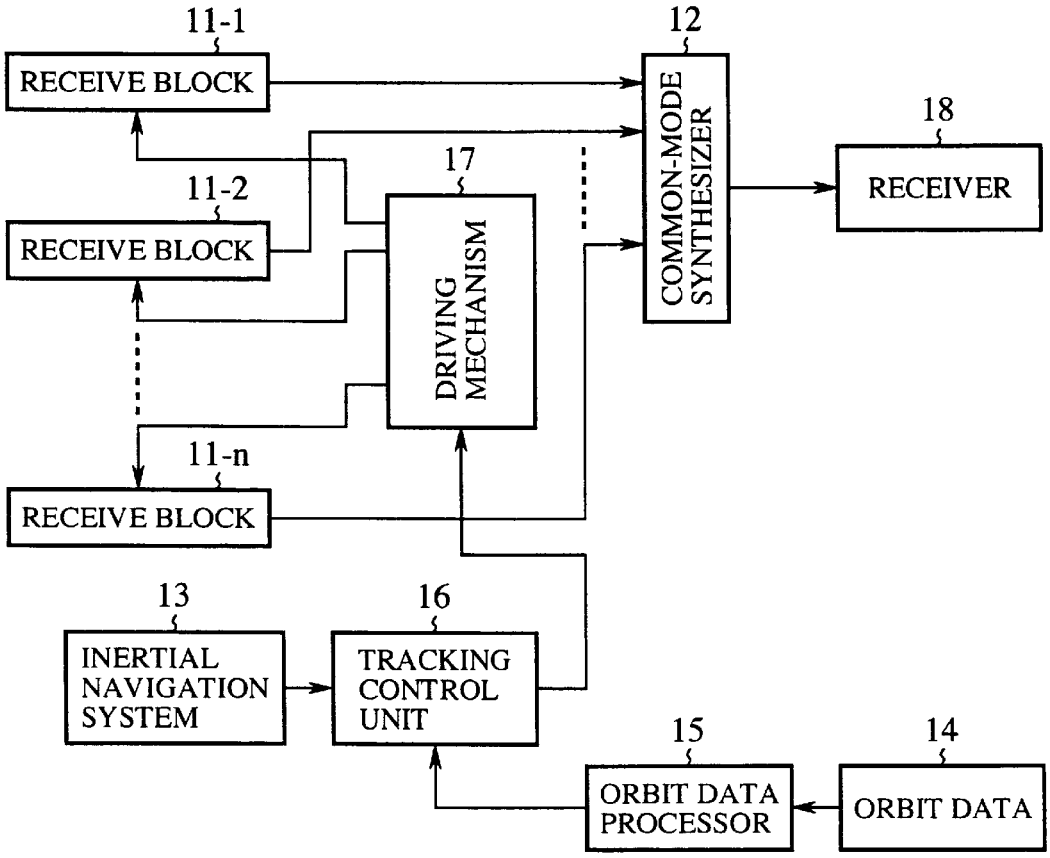
FIG.10 (PRIOR ART)
FIG. 10 is a block diagram showing the structure of an prior art antenna controller.

FIG. 9 is a block diagram showing the structure of an antenna controller according to a fourth embodiment of the present invention. In the figure, the same components as those of the antenna controller according to the above-mentioned second embodiment are designated by the same reference numerals as shown in FIG. 5, and therefore the explanation of those components will be omitted hereafter. Furthermore, in FIG. 9, reference numeral 9 denotes a satellite position information generation unit for generating position information on the position of a mobile satellite from one minute to the next, and for sending the position information on the mobile satellite generated to an antenna beam direction calculation unit 3, to direct the antenna beam of an antenna unit 1 toward the mobile satellite. The antenna controller according to the fourth embodiment differs from that according to the above-mentioned second embodiment in that it directs the antenna beam of the antenna unit 1 toward not a geostationary satellite but a mobile satellite. The antenna controller according to the fourth embodiment can direct the antenna beam of the antenna unit 1 toward another target other than the mobile satellite if it can generate position information on the other target from one minute to the next. Since a basic operation of the antenna controller according to the fourth embodiment is the same as that of the antenna controller according to the above-mentioned second embodiment, only part of the operation of the antenna controller which differs from that of the antenna controller according to the second embodiment will be explained hereafter. The satellite position information generation unit 9 generates position information on the mobile satellite, i.e., data on the latitude and longitude of the mobile satellite from one minute to the next, and adds a time tag to it before storing it in a built-in memory (not shown in the figure). The satellite position information generation unit 9 then reads the latitude and longitude data from the memory at a predetermined time and outputs the data to an antenna beam direction calculation unit 3.

As mentioned above, in accordance with the fourth embodiment of the present invention, even if output data of the existing inertial navigation system 5 installed in a mobile body, such as an aircraft, has a delay and the antenna has a small beamwidth, since the antenna controller estimates a delay of the motion data measured by the inertial navigation system 5 by using motion data calculated from output data of a 3-axis magnetic bearing sensor 7 and then corrects the measurement time of the motion data from the inertial navigation system 5 in consideration of the estimated delay and estimates future or current motion data, the antenna controller can direct the antenna beam of the antenna toward a moving object, such as a mobile satellite, with a high degree of accuracy Many widely different embodiments of the present invention may be constructed without departing from the spirit and scope of the present invention. It should be understood that the present invention is not limited to the specific embodiments described in the specification, except as defined in the appended claims.

What is claimed is:

1. An antenna control method for controlling a direction of an antenna beam of an antenna installed in a mobile body, for a purpose of satellite communication or satellite broadcast reception using a satellite, said method comprising the steps of:

in order to estimate a delay of motion information on a motion of said mobile body which is acquired by an inertial navigation system, separately acquiring motion information on the motion of said mobile body;

estimating the delay of the motion information acquired by said inertial navigation system based on the motion information separately acquired and the motion information acquired by said inertial navigation system; and calculating a direction of the antenna beam in consideration of the estimated delay to direct the antenna beam toward said satellite.

2. The antenna control method according to claim 1, where said separately acquiring step is the step of acquiring the motion information on the motion of said mobile body by using a 3-axis angular-velocity sensor.

3. The antenna control method according to claim 1, where said separately acquiring step is the step of acquiring the motion information on the motion of said mobile body by using a 3-axis magnetic bearing sensor.

4. An antenna controller for controlling a direction of an antenna beam of an antenna means, which is installed in a mobile body, for receiving an electromagnetic wave from a geostationary satellite, for a purpose of satellite communication or satellite broadcast reception using said geostationary satellite, said antenna controller comprising:

an antenna beam control means for controlling the direction of the antenna beam of said antenna means;

an inertial navigation system for acquiring motion information on a motion of said mobile body;

an antenna beam direction calculation means for calculating the direction of the antenna beam based on the motion information from said inertial navigation system to direct the antenna beam toward said geostationary satellite;

a motion information acquisition means for separately acquiring motion information on the motion of said mobile body; and a motion estimation means for estimating a delay of the motion information acquired by said inertial navigation system based on the motion information acquired by said inertial navigation system and the motion information acquired by said motion information acquisition means, and for estimating motion information to be sent to said antenna beam direction calculation means in consideration of the estimated delay.

5. The antenna controller according to claim 4, wherein said motion information acquisition means has a 3-axis angular-velocity sensor.

6. The antenna controller according to claim 4, wherein said motion information acquisition means has a 3-axis magnetic bearing sensor.

7. An antenna controller for controlling a direction of an antenna beam of an antenna means, which is installed in a mobile body, for receiving an electromagnetic wave from a mobile satellite, for a purpose of satellite communication or satellite broadcast reception using said mobile satellite, said antenna controller comprising:

an antenna beam control means for controlling the direction of the antenna beam of said antenna means;

an inertial navigation system for acquiring motion information on a motion of said mobile body;

an antenna beam direction calculation means for calculating the direction of the antenna beam based on the motion information from said inertial navigation system to direct the antenna beam toward said mobile satellite;

an satellite position information generation means for generating information on said mobile satellite from one minute to the next and for sending the position information to said antenna beam direction calculation means;

a motion information acquisition means for separately acquiring motion information on the motion of said mobile body; and a motion estimation means for estimating a delay of the motion information acquired by said inertial navigation system based on the motion information acquired by said inertial navigation system and the motion information acquired by said motion information acquisition means, and for estimating motion information to be sent to said antenna beam direction calculation means in consideration of the estimated delay.

8. The antenna controller according to claim 7, wherein said motion information acquisition means has a 3-axis angular-velocity sensor.

9. The antenna controller according to claim 7, wherein said motion information acquisition means has a 3-axis magnetic bearing sensor.

* * * * *